US010094560B1

(12) United States Patent
Doyle et al.

(10) Patent No.: US 10,094,560 B1
(45) Date of Patent: Oct. 9, 2018

(54) SOLID AND BLACK WASTE MITIGATION SYSTEM AND PROCESS

(71) Applicants: Leidos, Inc., Reston, VA (US); Defense Life Sciences, Inc., Alexandria, VA (US)

(72) Inventors: Geoffrey Louis Doyle, Charlestown, MD (US); Jerry B. Warner, Alexandria, VA (US); Kunihiro Nakamoto, Chicago, IL (US)

(73) Assignees: Leidos, Inc., Reston, VA (US); Defense Life Sciences, Inc., Alexandria, VA (US)

( * ) Notice: Subject to any disclaimer, the term of this patent is extended or adjusted under 35 U.S.C. 154(b) by 407 days.

(21) Appl. No.: 14/801,048

(22) Filed: Jul. 16, 2015

Related U.S. Application Data

(60) Provisional application No. 62/025,544, filed on Jul. 17, 2014.

(51) Int. Cl.
*F23G 5/027* (2006.01)
*F23G 5/44* (2006.01)
(Continued)

(52) U.S. Cl.
CPC ..... *F23G 5/0276* (2013.01); *C10J 3/007* (2013.01); *F23G 5/12* (2013.01); *F23G 5/444* (2013.01);
(Continued)

(58) Field of Classification Search
CPC ..... C10J 3/007; A47K 11/023; F23G 5/0276; F23G 7/001; F23G 2201/30;
(Continued)

(56) References Cited

U.S. PATENT DOCUMENTS 7,013,648 B2 * 3/2006 Griffin ..... F23D 14/62 60/737
7,878,131 B2 * 2/2011 Becchetti ..... C10J 3/66 110/220
(Continued)

FOREIGN PATENT DOCUMENTS

GB 1036879 A * 7/1966 ..... F23G 5/00

OTHER PUBLICATIONS

Knowlton, L. and Pickard, D., U.S. Army Natick Soldier Research, Development and Engineering Center (NSRDEC); Diebold, J., Lasnik, L., Lilley, A., and Browne, K., Community Power Corporation, "On-Site Field-Feeding Waste to Energy Converter," 8 pp., http://nsrdec.natick.army.mil/LIBRARY/00-09/R08-105.pdf.
(Continued)

*Primary Examiner* — David J Laux
(74) *Attorney, Agent, or Firm* — Dawn-Marie Bey; Bey & Cotropia PLLC

(57) ABSTRACT

A system for waste processing includes a feeder for receiving a waste stream of carbonaceous materials, multiple independently controllable augers, a reactor and an incinerator. The reactor receives a waste stream from the feeder and using a controllable heating element assembly converts the carbonaceous materials in the waste stream to syngas. The incinerator uses the syngas from the reactor to incinerate separately received black water waste from a storage tank.

15 Claims, 19 Drawing Sheets

(51) Int. Cl.
*F23G 5/12* (2006.01)
*C10J 3/00* (2006.01)

(52) U.S. Cl.
CPC ..... *F23G 5/446* (2013.01); *C10J 2200/15* (2013.01); *C10J 2300/0946* (2013.01); *F23G 2203/70* (2013.01); *F23G 2900/50001* (2013.01)

(58) Field of Classification Search
CPC ..... F23G 2201/303; F23G 2201/40; F23G 2900/50001
See application file for complete search history.

(56) References Cited

U.S. PATENT DOCUMENTS 8,328,993 B2 * 12/2012 Feerer ..... C10B 47/44 202/118
8,533,873 B2 * 9/2013 West, Jr. ..... A47K 11/023 4/111.1
2014/0021028 A1 1/2014 Paganessi et al. ..... 201/1

OTHER PUBLICATIONS

Taylor, P., "Minimizing the Footprint of Deployed Bases: Army Approaches to Waste to Energy Conversion." U.S. Army Research, Development and Engineering Command (RDECOM), 14 pp., May 7, 2009.

Valdes, J. J. and Warner, J., "Tactical Garbage to Energy Refinery," Research and Technology Directorate and Defense Life Sciences, Edgewood Chemical Biological Center, U.S. Army Research, Development and Engineering Command, ECBC-TR-713, 33 pp., Oct. 2009.

Warner, J. and Haggerson, C. M., Defense Life Sciences; Knoeller, S. L., Craig, B. D., and Fink, C. W., AMMTIAC, "Tactical Renewable Energy Production—Converting Waste and Biomass to Energy and Fuel," The AMMTIAC Quarterly, vol. 4, No. 3, 2009, http://ammtiac.alionscience.com/quarterly.

"Tactical Garbage to Energy Refinery (TGER) 2.0, Final Report," Prepared by SAIC, Jan. 2013, 45 pp.

* cited by examiner

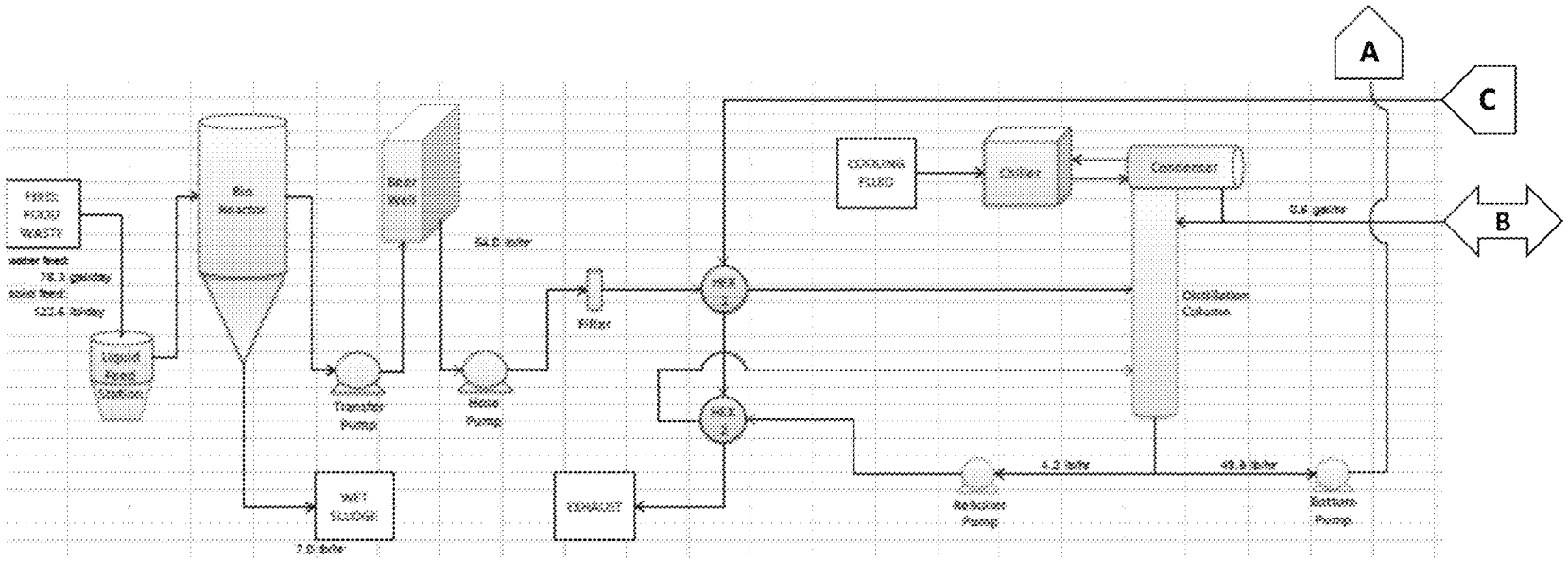
FIGURE 1A – Prior Art

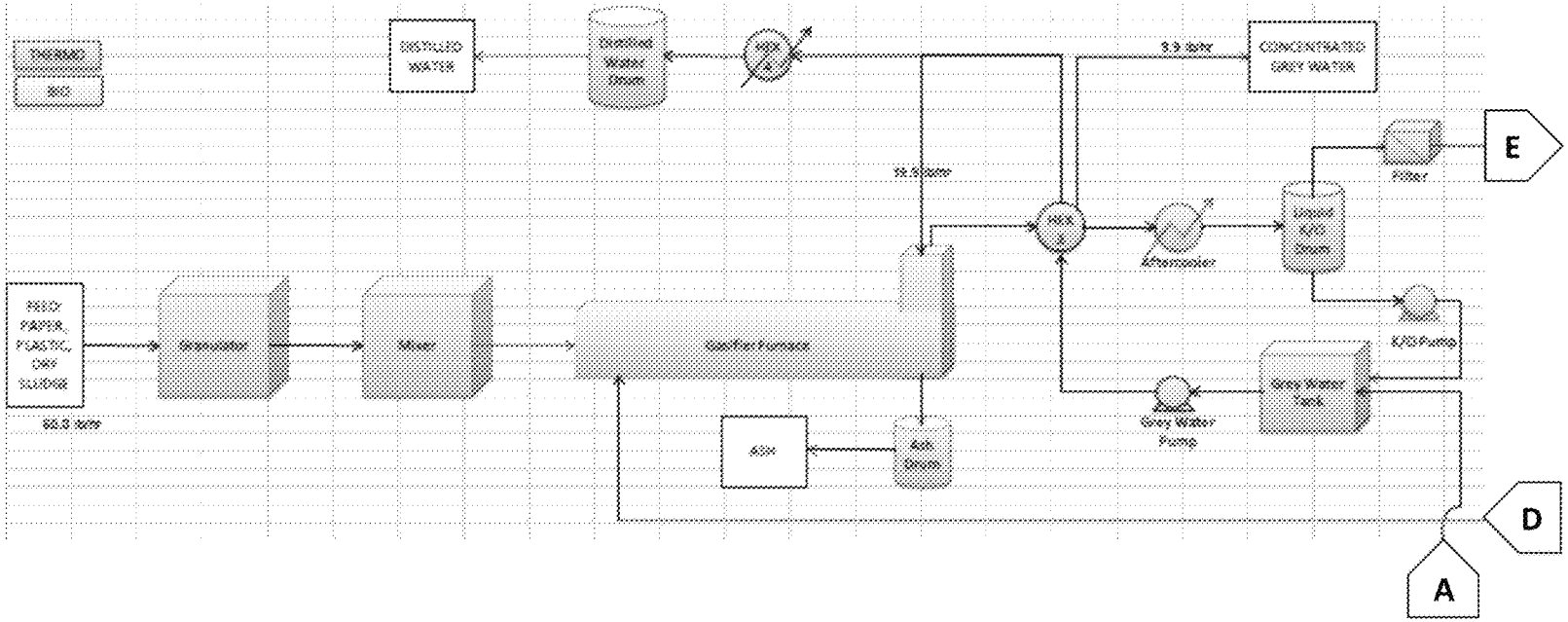
FIGURE 1B – Prior Art

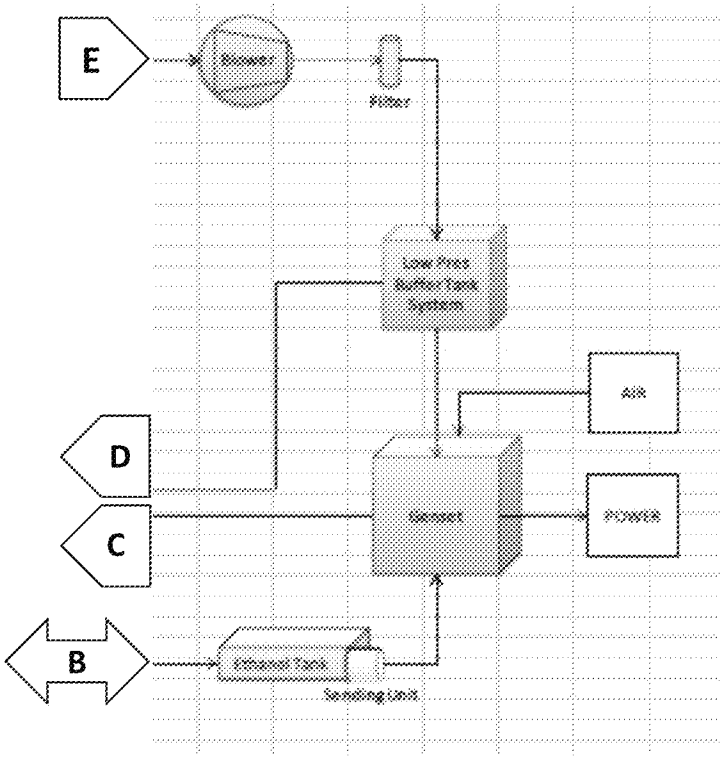
FIGURE 1C –Prior Art

SOLID AND BLACK WASTE MITIGATION SYSTEM AND PROCESS

CROSS-REFERENCE TO RELATED APPLICATIONS

The present application claims benefit of the filing date of U.S. provisional patent application No. 62/025,544 filed Jul. 17, 2014 entitled "Solid and Black Waste Mitigation System," the entire contents of which is incorporated herein.

GOVERNMENT LICENSE RIGHTS

The government of the United States of America retains a non-exclusive, irrevocable, royalty-free license in one or more embodiments herein pursuant to Army Contract No. W911QY-14-C-0091.

FIELD OF THE EMBODIMENTS

The embodiments herein relate generally to systems and methods for mitigating waste. More particularly, the embodiments relate to an improved gasifier/reactor configuration, for implementation in a waste mitigation system, including mitigation of black water waste.

BACKGROUND OF THE EMBODIMENTS

Humans generate and produce waste. The handling of waste is particularly burdensome in military situations, where military units may need to be relatively small and mobile. The personnel in these units will generate waste from both administrative activities and field feeding. This waste generally contains items such as paper, cardboard, plastics and food waste. The personnel also produce waste in the form of black and grey water. The handling and disposal of these waste streams consume significant resources, e.g., labor and energy. Accordingly, there is continued interest in the availability of a mobile, easy to operate, environmentally friendly and efficient system to process waste streams to reduce their volume and mass and to convert the waste into a useful energy source to support the military unit in the field. The advantages of an efficient waste to energy system would greatly simplify the logistics of waste disposal, decrease the consumption of nonrenewable energy required to transport and treat the waste, and supply extra power to meet site-specific needs.

To this end, the Tactical Garbage to Energy Refinery (TGER) was designed and has been iteratively improved responsive to interest and funding from the U.S. Army. The TGER was initially specifically developed as a hybrid system for the tactical disposal of military wastes, accompanied by the generation of usable electrical power. In operation, the 1 ton of waste per day capacity of the TGER was designed to be compatible with support of a force of approximately 550 personnel at remote locations, and the composition of administrative and food waste they generate. Its two main subsystems include gasification and fermentation (bio-reaction), are, separately, established technologies with applications in the treatment of various waste materials.

The TGER system was intended to be capable of converting military field wastes into usable electric power via a standard diesel generator. The TGER utilized a hybrid design of gasification to convert dry solid wastes to syngas and fermentation (i.e., bio-reaction) to process wet food wastes to hydrous ethanol. The syngas and ethanol were then blended with air and fed to the generator, gradually displacing regular diesel fuel. An exemplary implementation of the unit operations involved in the two parallel processes (THERMO for gasification and BIO for bio-reaction) of the TGER system are outlined in prior art FIGS. 1*a* to 1*c*.

An exemplary bio-reaction section of FIG. 1*a* consisted of a feed station, a bio-reactor, a beer well, two filters, a distillation system, an ethanol tank, and a gray water tank. In this section the feed material is mixed with enzymes, yeast, and antibiotic additives in the bio-reactor to assist in the breakdown of carbohydrates via the fermentation process. The liquid material containing alcohol in the bio-reactor is transferred to the beer well, which serves as a surge tank and fermentation finisher. Sludge is also formed in the bio-reactor that must be periodically removed. The sludge may be dried and added to the feed of the gasifier for additional energy recovery. From the beer well, the aqueous ethanol is pumped through a heat exchanger (using exhaust from the genset as the heating source) to a distillation column. The distillation column operates at about 100° C. with a re-circulating liquid bottom stream to increase the recovery yield of fuel ethanol. A chiller-cooled condenser at the top of the column condenses the vapor. A reflux stream is sent back to the distillation column from the condenser to increase the product purity to 85 percent ethanol with 15 percent water. The final product stream is sent to the storage tank at a rate of about 0.6 gallons per hour. The ethanol is then used, along with the syngas from the gasifier, as fuel for the genset (replacing diesel fuel) to generate electrical power at a target of 60 (kilowatts) kW.

With respect to the exemplary gasification process of FIG. 1*b*, the pyrolytic gasification section consists of a granulator, mixer, gasifier, high hydrocarbon catalytic converter, two heat exchangers, condenser, dual filters, blower, and syngas surge tank. In this section, typical dry feed, such as a mixture of paper, plastics, cardboard, and recycled bio-reactor sludge, is shredded (to a target particle size of ¼ to ½ inch), mixed, and fed to the auger gasifier. The syngas produced in the gasifier is then conditioned through hot gas filtration, tars/oils catalytic cracking, condensing, and low temperature gas filtration before being fed to the genset through the buffer tank system. The gasifier is operated at a gradient temperature of 200° to 900° C. and atmospheric pressure, with a controlled amount of steam.

Finally, the exemplary genset section of FIG. 1*c* used is commercially available, e.g., Kohler 60REOZJB generator designed for use with #2 diesel fuel. Minimal changes were made to the genset to accommodate different fuels, e.g., JP-8 (diesel jet fuel). The genset is started using diesel. As syngas and ethanol are available from the TGER process, they replace a portion of the diesel and reduce usage from about 4.6 gallons per hour (gal/hr) to a target of 0.5 gal/hr under normal loading conditions. The syngas and the ethanol are mixed and fed into the fuel-air delivery system of the genset, and diesel is used as needed to maintain the desired electrical generation rate when the syngas and ethanol produced cannot meet the desired power requirement.

The prior art TGER system of FIGS. 1*a*-1*c*, though operational, is not optimal. There remains a need for improved subsystems and components to reduce size and footprint, while improving or at least maintaining efficiency. More particularly, to provide maximum support to, e.g., Small Unit Combat Outpost (COP) in austere environments, subsystems and components should be improved so as to address numerous issues related to deployment, black water waste, efficient energy consumption, environmental challenges and security.

SUMMARY OF THE EMBODIMENTS

In a first embodiment, a system for waste processing is described. The system includes: a feeder for receiving a waste stream of carbonaceous materials, the feeder including a first controllable auger for directing the waste stream; a reactor for receiving the directed waste stream from the feeder, the reactor including a reactor tube, second controllable auger, and a first heating element assembly for converting the carbonaceous materials to syngas and ash; and an incinerator for receiving the syngas from the reactor and for receiving black water waste from a storage tank, wherein the incinerator includes at least one burner fueled by the syngas for incinerating the received black water waste.

In a second embodiment, a modular waste processing system is described. The system includes: a first self-contained waste pre-processing system for receiving heterogeneous carbonaceous waste of varying size and composition and processing to form a homogeneous single stream of carbonaceous waste; a second self-contained waste processing system for receiving the single stream of homogenous carbonaceous waste from the first self-contained waste pre-processing system via a first conduit and for processing the single stream of homogenous carbonaceous waste to a syngas and ash; and a third self-contained waste producing system for receiving and storing black water waste therein and for providing the black water waste to the second self-contained waste processing system via a second conduit, wherein the second self-contained waste processing system incinerates the black water waste from the third self-contained waste producing system using the syngas produced therein as fuel for an incinerator.

SUMMARY OF THE FIGURES

The Summary of the Embodiments, as well as the following Detailed Description, is best understood when read in conjunction with the following exemplary figures:

FIGS. 1*a*-1*c* illustrate prior art process flow and components of an early TGER system;

DETAILED DESCRIPTION

Figure 2:
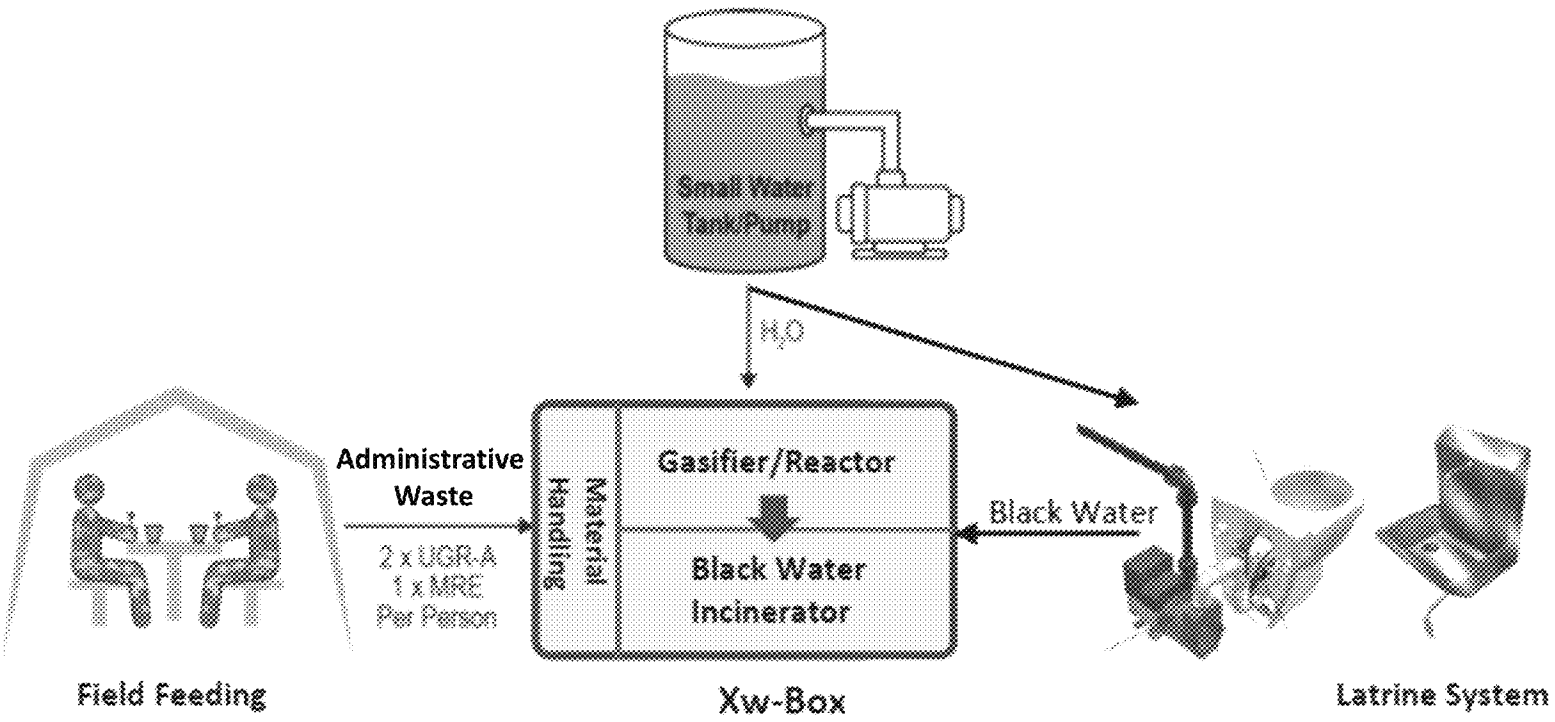
FIG. 2 is a generalized schematic of an Xw-Box system of the present embodiments included within a particular application environment.

The present embodiments are directed to an improved waste mitigation system referred to herein as an Xw-Box system. A generalized schematic of an Xw-Box system included within a particularized scenario is shown in FIG. 2. The Xw-Box system of the present embodiments no longer includes the bio-reaction section of FIG. 1*a*. Both liquid and dry waste is combined in a single waste stream for gasification. The Xw-Box system of the present embodiments, including an improved gasifier/reactor and incinerator, is designed to convert a single stream of unsorted predominantly solid waste from, e.g., 150 personnel (also called "pax") to syngas, which is then fed directly to the incinerator to incinerate, e.g., 75 pax black water waste, all while maintaining a recognizable small footprint and requiring one person for regular operations; minimizing hazardous waste production, smoke and odor; meeting field emission standards and minimizing consumables for operation. The system reduces tars/condensates formation; directs/efficient use of syngas/exhaust to simplified purpose (i.e., black water incineration); is mobile and configurable and requires minimal pre-sorting of waste to remove tramp materials (those waste components that do not contribute to syngas production such as metals and glass).

The improved Xw-Box system described and illustrated herein is intended to convert solid administrative waste such as paper documents and cardboard and plastic packaging materials, and food waste, e.g, carbonaceous materials, including those resulting from, for example, UGR-A meals (Unitized Group Rations) and MREs (Meals Ready to Eat), into syngas which powers an incinerator for destruction of human waste, e.g., black water. Some liquid content such as water, juices, and sauces are anticipated to be part of the food waste as well. Tables 1 and 2 below provide exemplary waste material composition by weight for 100 lbs. of representative waste. The waste includes whole MREs (food intact),

TABLE 1

| | 15 MREs lbs | Cardboard Cellulose lbs | Water bottles PET lbs | Plastic Flatware PS lbs | Storage Basket PP lbs | Bags PE lbs | Total lbs |
|---|---|---|---|---|---|---|---|
| Cellulosic | 5.5 | 57.5 | 0 | 0 | 0 | 0 | 63.0 |
| Plastic | 3.0 | 0 | 5.6 | 2.8 | 2.8 | 2.8 | 16.9 |
| Food | 18 | 0 | 0 | 0 | 0 | 0 | 18 |
| Tramp Foil, Glass | 0.7 | 0 | 0 | 0 | 0 | 0 | 0.7 |
| | | | | | | | 98.6 |

TABLE 2

| Plastic Split | |
|---|---|
| PET | 40% |
| Polystyrene | 20% |
| Polypropylene | 20% |
| Polyolefin | 20% |
| | 100% |

packaging materials such as trash bags and cardboard boxes and other related solid waste such as plastic bottles, trays and flatware all of which could be included in the single solid waste stream and processed by the Xw-Box and the gasifier/reactor.

Figure 3A:
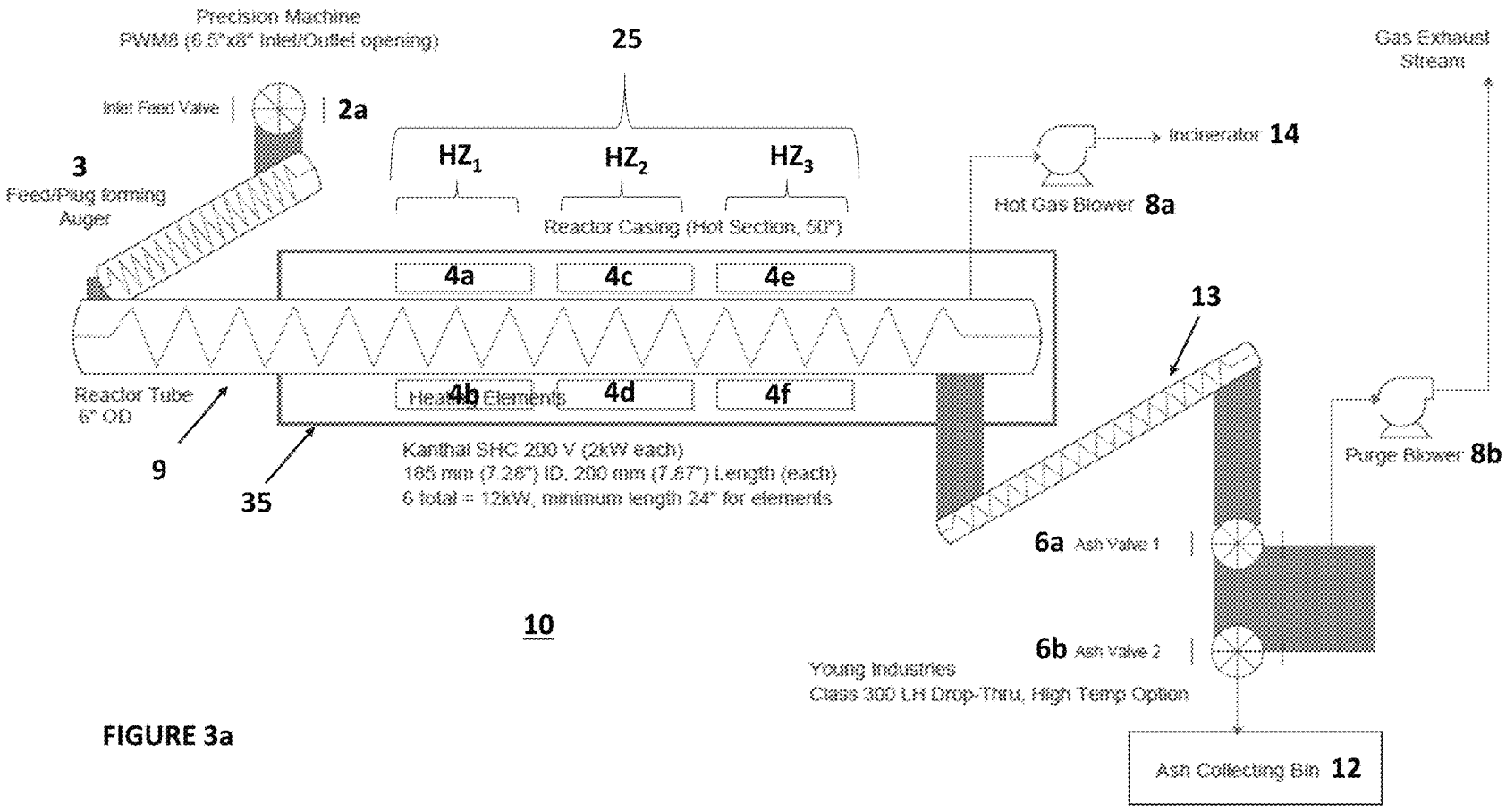
FIGS. 3*a*-3*b* are exemplary Xw-Box process flow and component diagrams in accordance with embodiments herein.
Figure 3B:
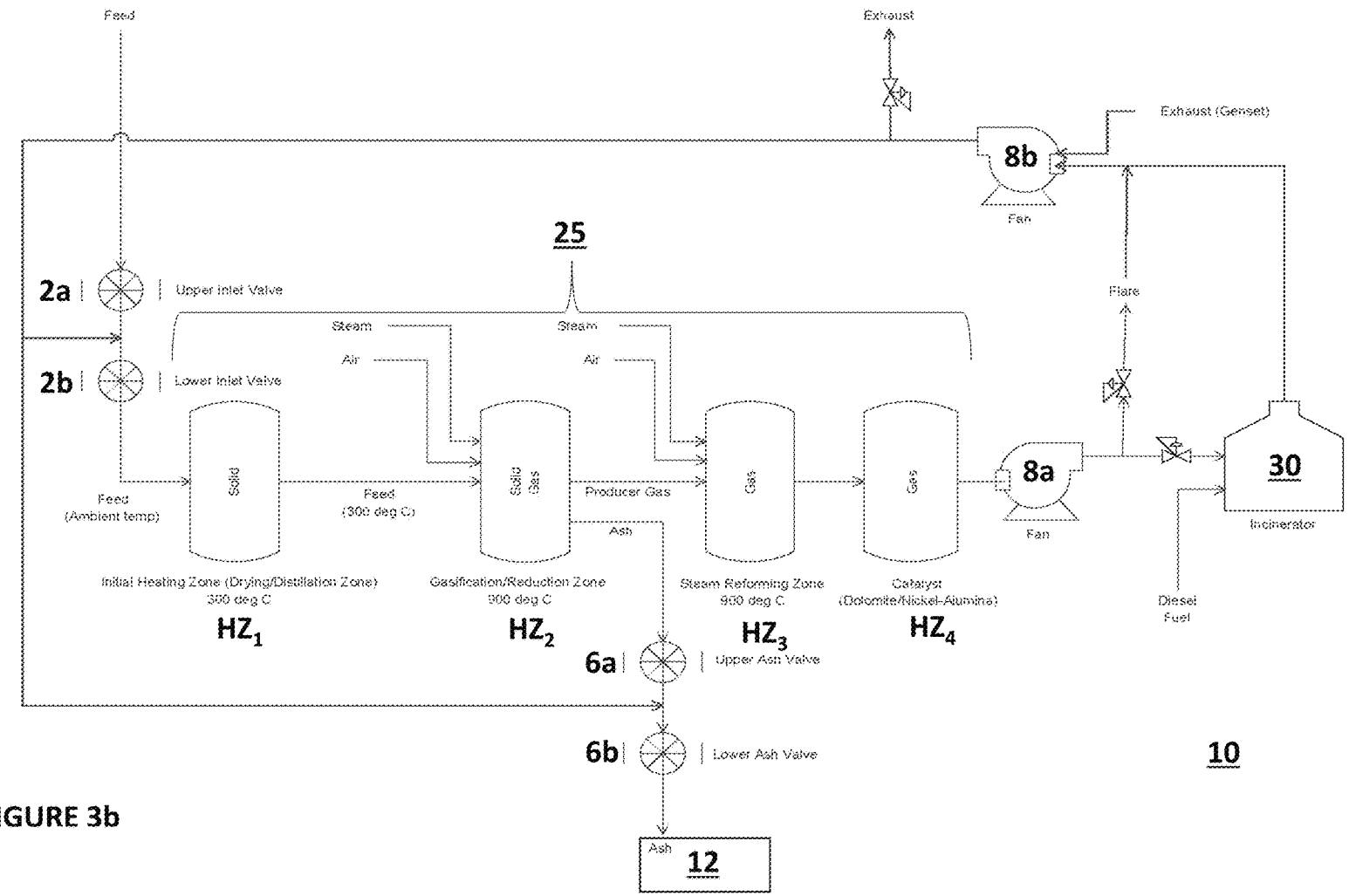

Referring to FIGS. 3*a*-3*b*, exemplary Xw-Box 10 process flow and component diagrams are shown. The diagrams depict gasification reactor and incineration elements of the Xw-Box and vary slightly with respect to included elements and placement thereof within the flow. FIG. 3*a* includes, among other elements, at least one inlet valve 2*a*, heating zones $HZ_1$-$HZ_3$ formed using at least one heating element and insulation assembly (25) including heating elements 4*a*-4*f* with ash valves 6*a*, 6*b* (a single valve may be sufficient) located after the last heating zone $HZ_3$ and fans/blowers 8*a*, 8*b*. FIG. 3*a* also illustrates a feed/plug forming auger conveyor 3 which feeds into a reactor tube 9 containing an auger and heated by heating elements 4*a*-4*f*. At least a portion of the reactor tube 9 and heating elements 4*a*-4*f* may be included in a reactor casing 35 providing heat insulation and structural support to the reactor tube section. An additional auger conveyer 13, is used to collect the resulting ash and move it to an ash collection bin 12 in real-time and during continuous operation of the Xw-Box 10. There is no need to power down and cool down the Xw-Box 10 to collect and remove the ash. By way of example only, FIG. 3*a* provides for detailed component specifications, including component dimensions and representative commercial-off-the-shelf (COTS) components which may be incorporated into the Xw-Box 10.

In the slightly altered embodiment of FIG. 3*a*, FIG. 3*b* includes, among other components, multiple inlet valves 2*a*, 2*b*, for improved stoichiometric control, multiple heating zones $HZ_1$-$HZ_4$, ash valves 6*a*, 6*b*, and fans/blowers 8*a*, 8*b*. FIG. 3*b* also illustrates placement of the ash valves 6*a*, 6*b* after heating zone $HZ_2$ and shows input of steam and air at heating zones $HZ_2$ and $HZ_3$. $HZ_4$ is depicted as containing catalysts for catalytic reforming/clean-up of the syngas. One skilled in the art will recognize that the inclusion of a catalyst bed may not be necessary depending on the quality of gas desired/required and further recognizes that component types, number and placement may be altered to account for variations such as the composition of feed waste input and desired syngas properties output and overall size and configuration of the system, etc. while still falling within the scope of the present embodiments.

Figure 4A:
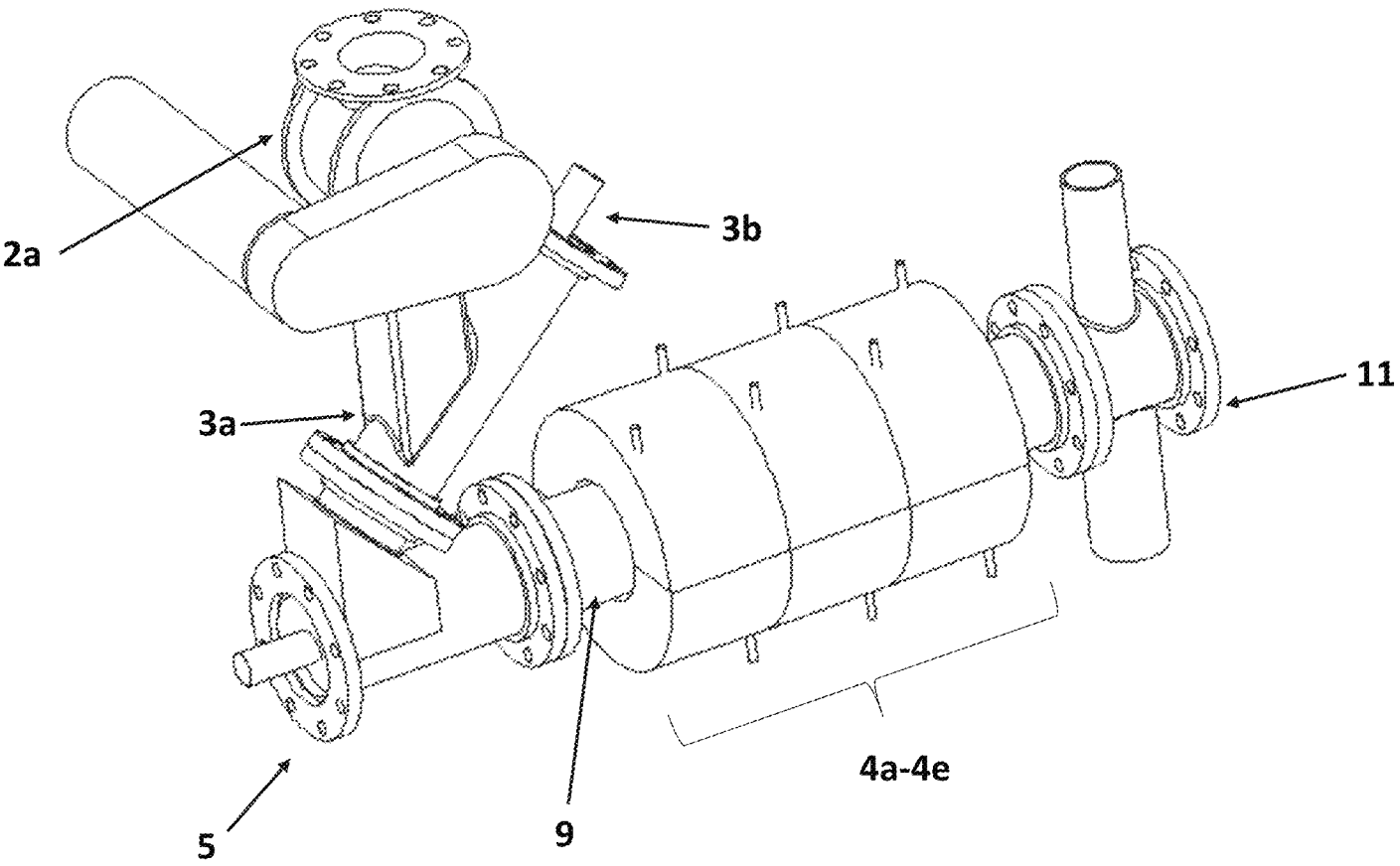
FIGS. 4*a*-4*c* provide more detailed views of portions of the Xw-Box systems of the present embodiments.
Figure 4B:
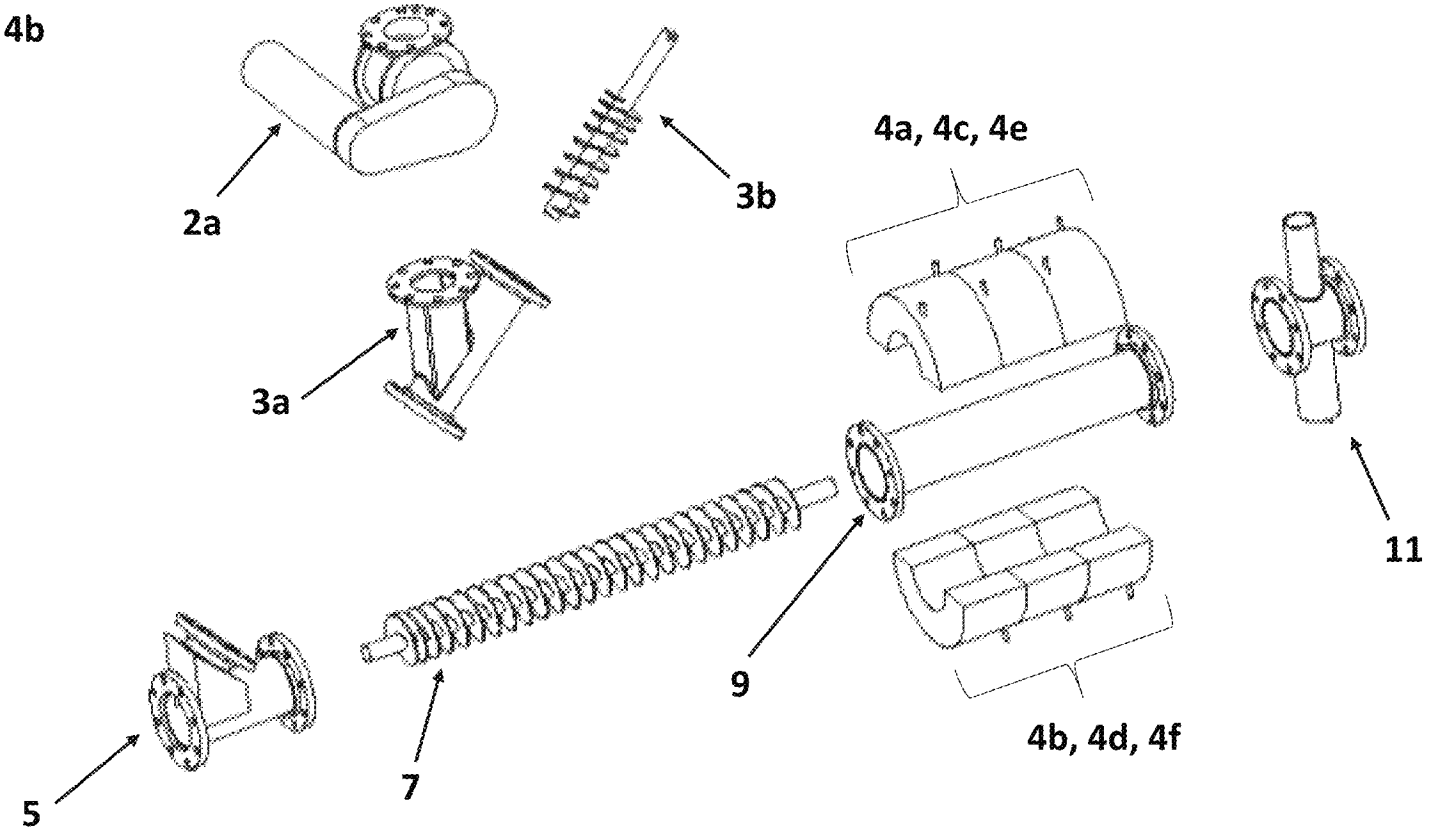
Figure 4C:
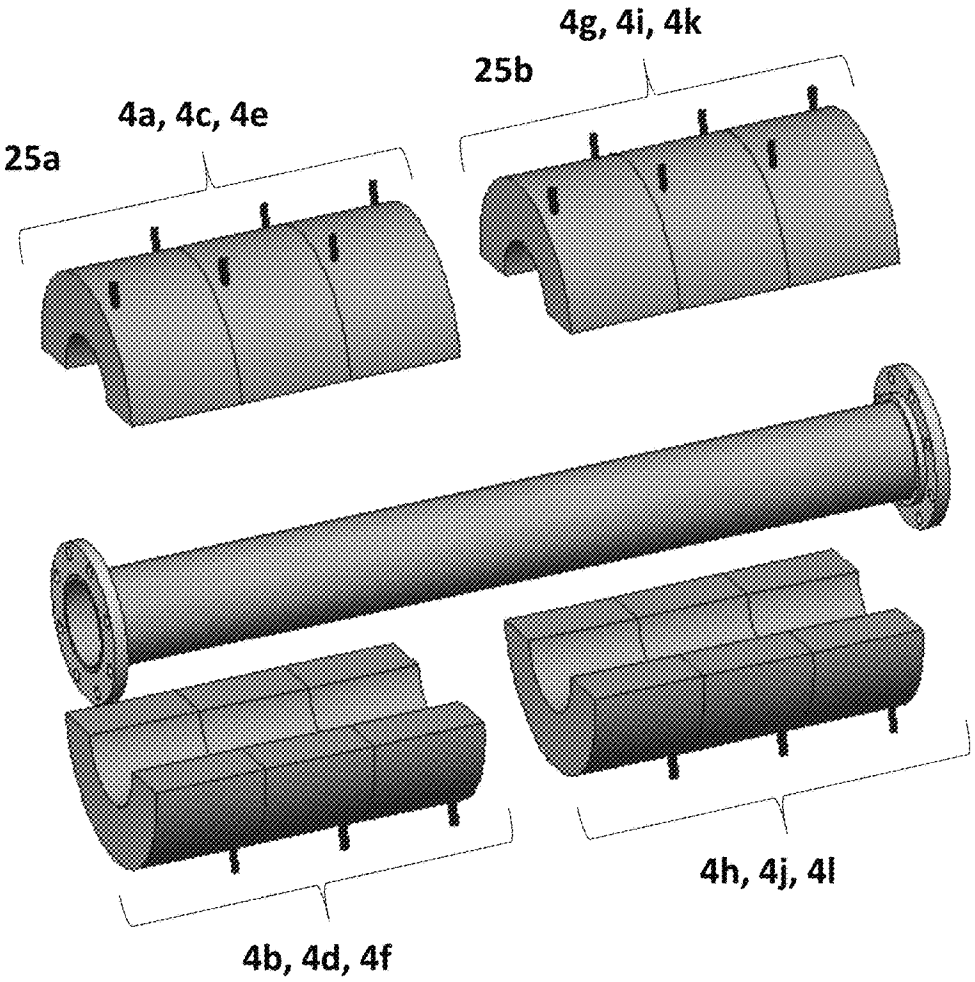

FIGS. 4*a*-4*c* provide more detailed views of the reactor portions of the Xw-Box 10 of FIG. 3*a*. More particularly, the embodiments include: rotary valve/material feeder 2*a*, feed/plug auger housing 3*a*, primary feed/plug auger 3*b*, reactor entrance housing 5, main auger 7, main reactor tube 9, reactor end, gas/ash separation 11 and clamshell-type heating element and insulation assemblies 4*a*-4*f*. In operation, waste material is metered and enters at the rotary air lock valve of the material feeder 2*a* to the feed tube connected with the feed/plug auger housing 3*a*. Although not required, the feed/plug auger 3*b* acts to condense the waste material in a plug-like fashion and continually move the waste material towards the reactor, which also helps to restrict air from entering the reactor. The waste material is sent down to the reactor through the plugging section by the feed/plug auger 3*b*. By adjusting the feed/plug auger speed, the waste density entering the reactor can be adjusted. Additionally, one or more resistive heaters may be located on or in the vicinity of the feed/plug auger housing 3*a* to remove ice and/or reduce moisture from around and within the housing.

The main auger 7 moves the waste material through the main reactor tube 9. The main auger speed can be adjusted independently from the feed/plug auger, allowing enough residence time through the main reactor tube 9 for optimal carbon conversion. Carbon conversion is achieved when the heater assembly 25 ramps up the temperature in the reactor tube 9 to above at least 670 degrees Celsius. In a preferred embodiment, the at least 670 degrees Celsius is achieved as quickly as possible (e.g., within approximately the first 20-30 inches of the reactor tube and by the second zone $HZ_2$) to preclude condensates forming in the system (e.g., tar, carbon, etc.).

When the processed waste material reaches the reactor end 11, the products of the carbon conversion are ash and syngas. In real-time, the ash is directed to the ash collection container 12 by at last one valve and the produced gas, i.e., syngas, is sent to the incinerator 14 by a high temperature gas blower 8*a*. The incinerator may include multi-fuel burners for syngas and/or diesel or other fuel use. Alternately, the syngas may be directed to an incinerator toilet rather than a centralized incinerator.

Figure 7A:
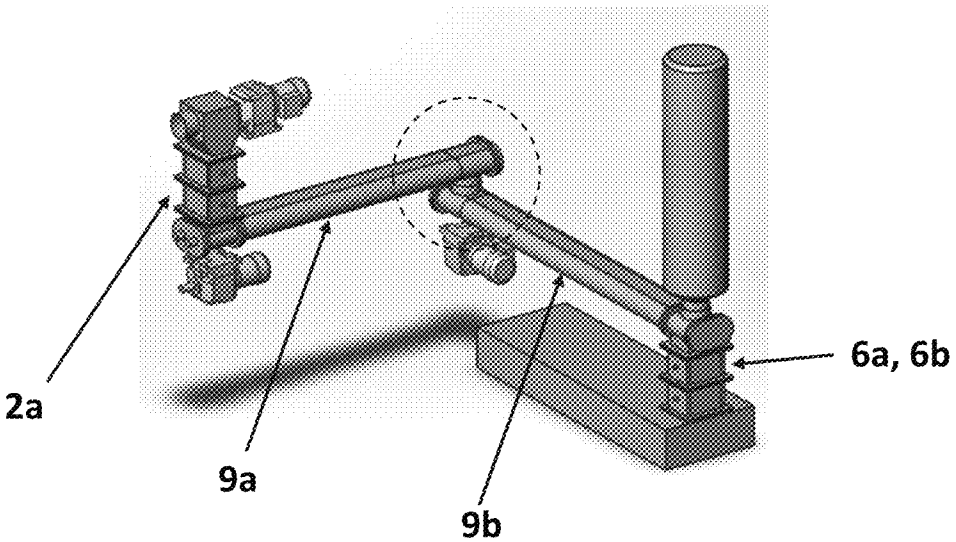
FIGS. 7*a* through 7*c* illustrate a stair step configuration and stacked configuration for a reactor tube in accordance with one or more embodiments herein.
Figure 7B:
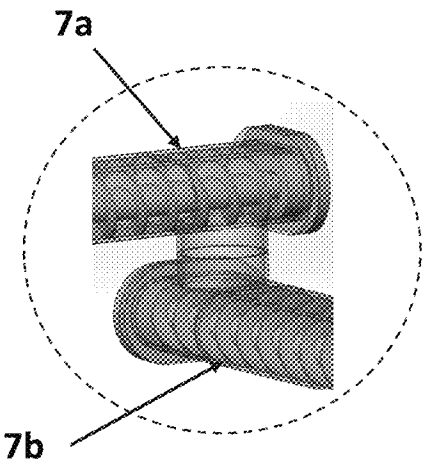
Figure 7C:
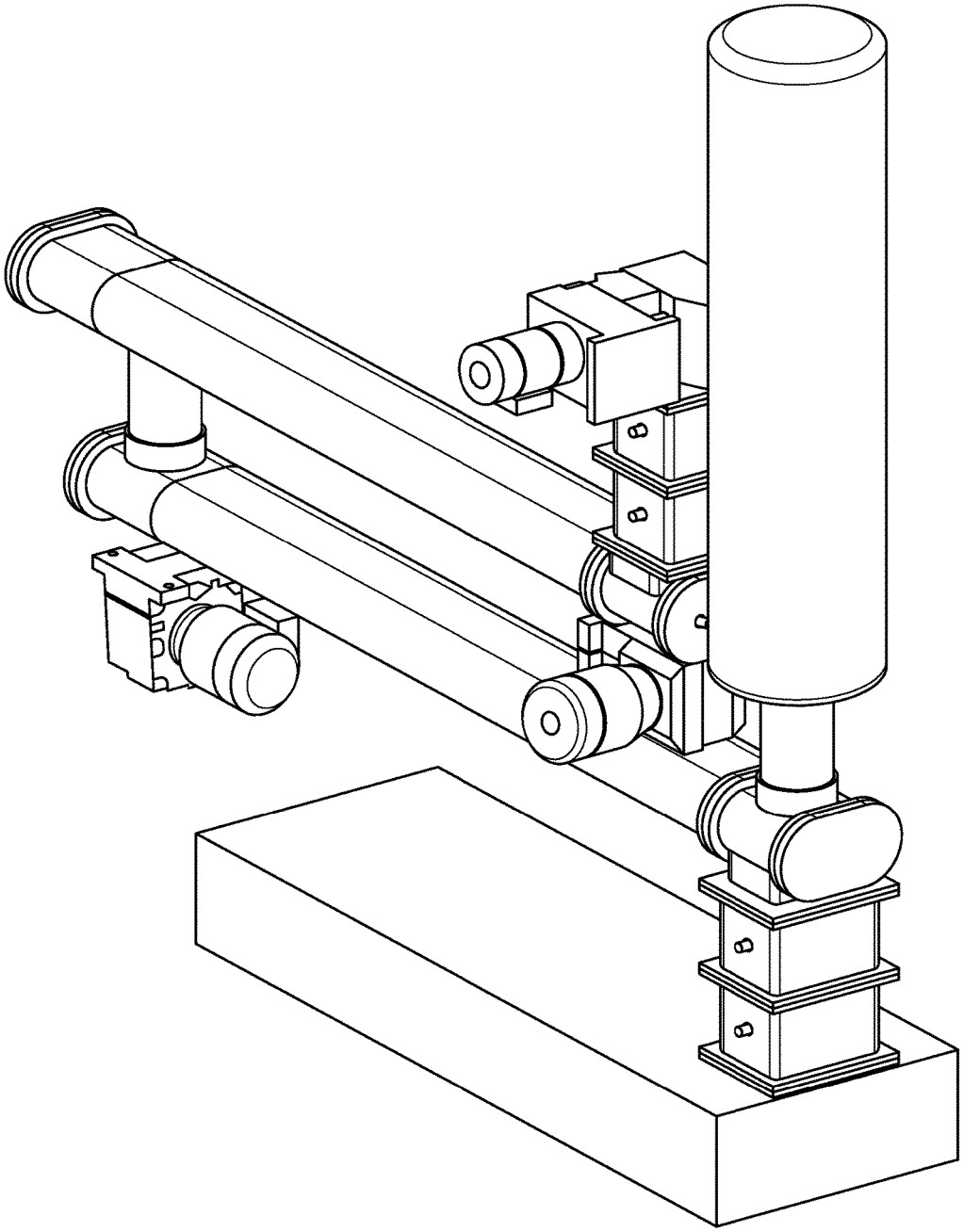

The separate feed and reactor augers configuration of FIGS. 3*b*, 4*a*, 4*b* provides an additional level of control to optimize density of the input waste stream. In situations where the density of the input material is above a certain level, the feed-plunger auger 3*b* may not be necessary (or used). On the contrary, if the density is below a certain level, without the feed-plunger auger 3*b*, in order to process the sufficient amount of waste material through the reactor tube 9 to produce a targeted amount of gas, the main auger 7 speed must be increased to the point where the feed rate is too fast. This increased feed rate to account for reduced density results in shorter residence times in the heat zones and incomplete gasification. Accordingly, using a separate feed auger, the bulk density of feed waste material can be adjusted at the entrance of the main reactor tube 9 via a higher feed/plug auger 3*b* speed than the main auger 7. And the main auger 7 speed can be independently adjusted to affect the optimum residence time in the reactor tube. Additional degrees of freedom and control of the waste stream may be realized by dual feed and dual reactor auger configurations, or a combination of dual and single auger configurations. Such configurations may utilize stacked, offset or zigzag auger relationships such as those illustrated in FIGS. 7*a*-7*c*.

Figure 5:
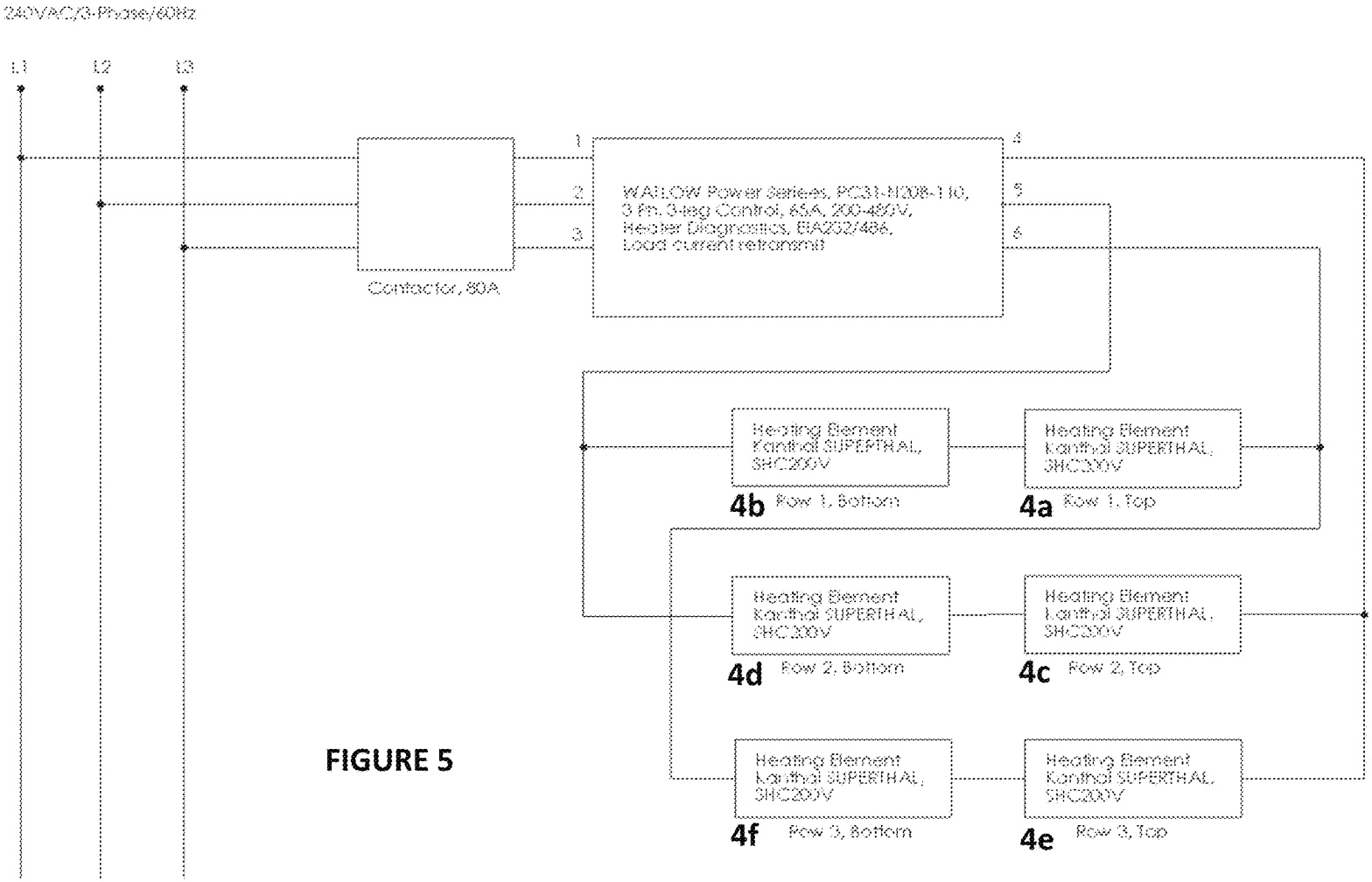
FIG. 5 provides a detailed view of an exemplary heating element configuration in accordance with one or more embodiments herein.

FIG. 4*c* illustrates a longer reactor tube enabling the use of multiple claimshell-type heating assemblies (25*a* and 25*b*), wherein heaters 25*a* and 25*b* can be separately controlled as discussed and illustrated in FIG. 5. This enhanced capability allows for greater flexibility and control of process stoichiometry which is advantageous particularly when processing unique waste stream compositions that may be quite different than the anticipated military base waste composition.

In FIG. 5, details of an exemplary heating element configuration are shown. Two heating elements are connected in series (4*a*/4*b*, 4*c*/$\mathbf{4}_d$, $\mathbf{4}_r$/4*f*) and three sets of heating elements are connected in a 3-phase delta configuration in accordance with a clamshell-type heating element and insulation assembly. Alternatively, should additional heating be required, more heating element assemblies can be added, and separately controlled, with a longer reactor tube or additional reactor sections as shown in FIG. 4*c*. A longer reactor tube configuration requires that the reactor assembly be installed in a larger container such as a BICON or by using multiple reactor tube sections in a TRICON (discussed below).

Figure 6:
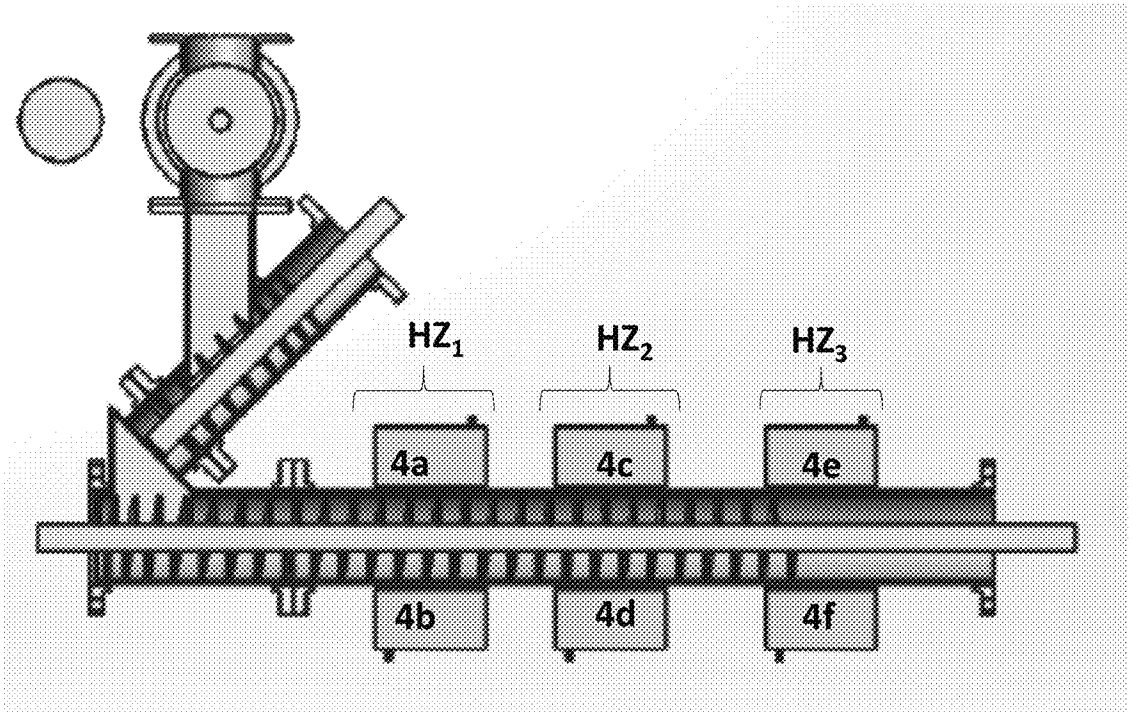
FIG. 6 provides a detailed view of an alternative exemplary heating element configuration in accordance with one or more embodiments herein.

FIG. 6 illustrates yet another alternative embodiment, wherein the three sets of 2*x* heating elements (4*a*/4*b*, 4*c*/4$_d$, 4$_e$/4*f*) are not immediately adjoining along the periphery of reactor tube 9, but instead the individual sets are spaced apart, thus clearly defining heating zones $HZ_1$-$HZ_3$. Depending on the requirements of the overall system, such spacing may be used for diagnostic point of entry, e.g., temperature or other sensors, and/or for introduction of air or steam as shown in FIG. 3*b*.

Additional modifications to the configurations discussed herein are also contemplated in accordance with size and containment requirements and limitations. For example, FIGS. 7*a* and 7*b*, contemplate a stair step configuration for the reactor tube 9, wherein dual tubes 9*a*, 9*b* each having a controllable main dual auger portion 7*a*, 7*b*, are connected in a stair-step configuration as shown. This allows for flexibility in the orientation of the reactor sections, which may be required to fit the system into standard size containers, such as TRICON or BICON containers. The use of dual augers, while not necessary, may allow for a reduction in overall reactor tube length as greater heat transfer between the waste material and reactor can be achieved. One skilled in the art recognizes that more than one stair-step section could be used. In another contemplated modification, FIG. 7*a* also illustrates double rotary star lock valves in place of the single valves at feeder 2*a* (FIGS. 3*a*, 4*a*, 4*b*) and at 6*a*, 6*b* (FIG. 3*a*).

The syngas produced by the reactor is provided to an incinerator which is abutted/configured to the gasifier outlet. The syngas is fed hot to incinerator burners which incinerate black water received separately from a personal hygiene system discussed below. The direct delivery of hot syngas to the incinerator mitigates gasifier problems due to condensation of tars and carbon deposits that form during the cooling of the syngas. The present embodiments eliminate the need for heat exchangers, high temperature filters, water knockout for tars, etc.

Further to the exemplary application of the embodiments described herein to support COP and military FOB (Forwarding Operating Base) operations, the embodiments herein may be designed so as to be contained in one or more TRICON or BICON containers which are used extensively by the United States Armed Forces. The TRICON is configured so that when three of them are secured together using the SeaLock connector, the resulting package has the same footprint as a 20 foot ISO intermodal container. Similarly, a BICON container is used by the United States Armed Forces for transport and storage and can be secured together with a second BICON to meet the 20 foot ISO intermodal container dimensions. The following configurations illustrate Tricon implementations for sheltering one or more of the Xw-Box configurations described herein.

Figure 8A:
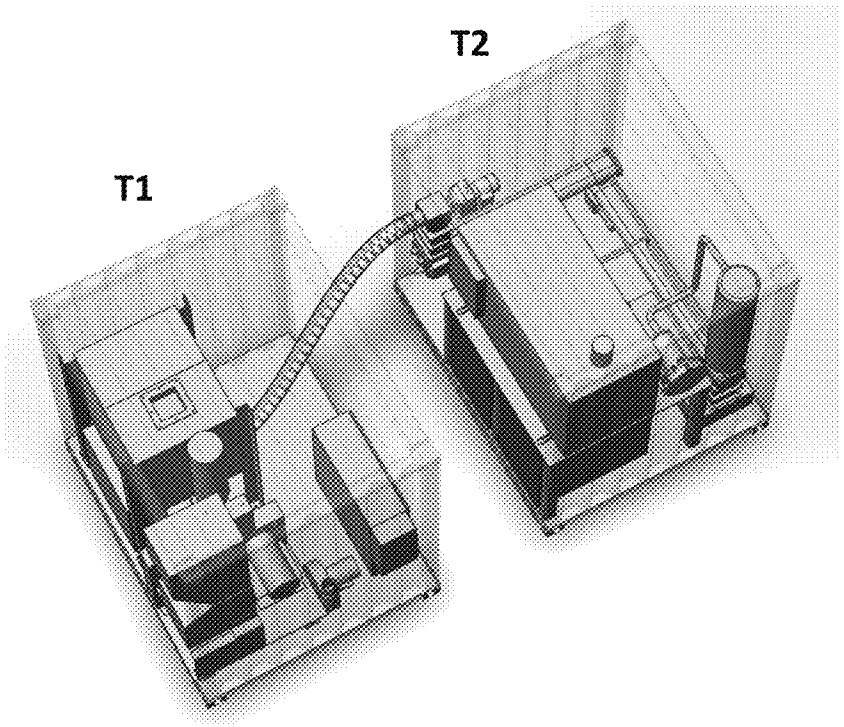
FIGS. 8*a*-8*d* illustrate various view of the systems of the present embodiments configured within Tricons.

Referring to FIG. 8*a*, TRICON 1 (T1), contains a system for initial material handling and preparation, i.e., material preprocessing, including a granulator, mixer and main control cabinet containing programmable logic controller (PLC) and power distribution unit (PDU). The material preprocessing includes homogenizing the consistency of different materials in a mixer/holding chamber that accepts the ground material, homogenizes it, and supplies the homogenized material on-demand to the gasifier. As part of the homogenizing, some drying may be applied using, for example, resistance heaters to supply thermal energy or, alternatively, using heat recovered from other Xw-Box system heat sources. The TRICON 2 (T2) is connected to T1 by an appropriate conduit, e.g., a flexible auger, at the feed tube of material feeder 2*a* (FIGS. 4*a* and 4*b*) and contains the syngas production and incinerator components including the main reactor, steam generator, optional catalytic reformer, incinerator, and possibly a diesel tank and water tank (which may be provided separately from the container T2).

Figure 8C:
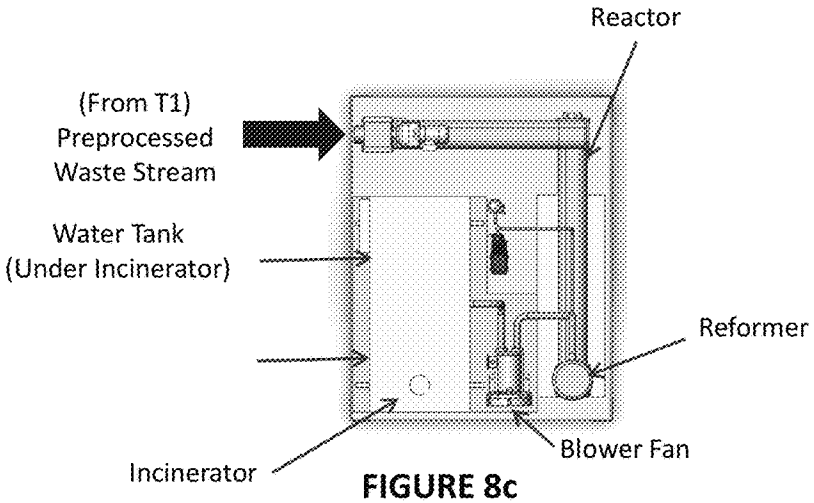
Figure 8D:
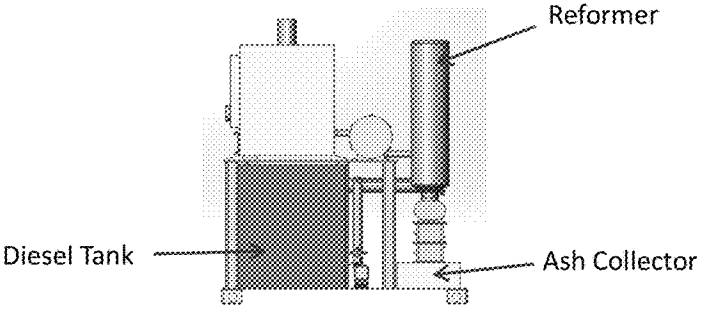
Figure 8B:
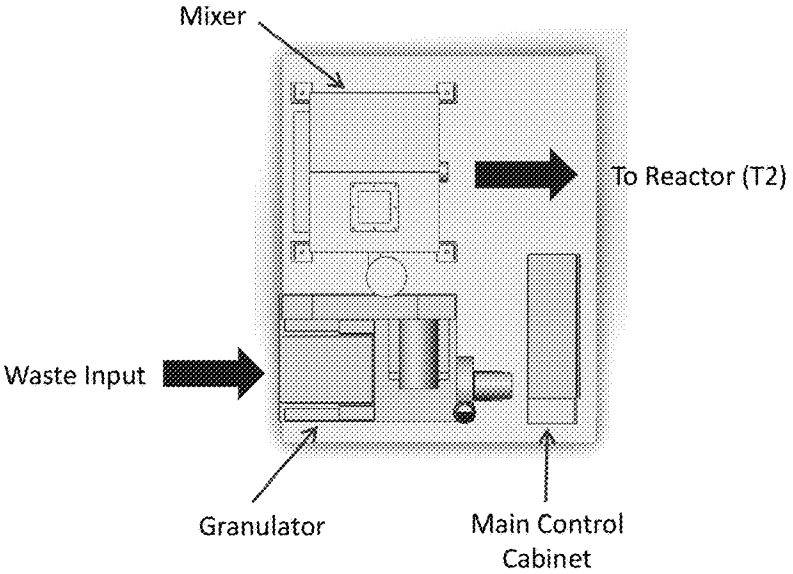

FIGS. 8*b*-8*d* show top and side views (T2 only) of the Tricons with components therein. The reactor as shown in FIG. 8*b* is in the alternative stair step configuration illustrated in FIGS. 7*a* and 7*b*.

Further to the containment scenarios of FIGS. 8*a*-8*d*, deployment schematics are shown in FIGS. 9*a*-9*d* which include a third TRICON (T3) housing personal hygiene/latrine facilities, e.g., standard or vacuum toilets and urinal, which produces human waste, e.g., black water. As discussed above, the syngas produced by the gasifier/reactor of the Xw-Box is used to power an incinerator to destroy the black water which is housed in a black water collection tank in T3. FIGS. 9*a*-9*d* disclose various exemplary deployment scenarios, accounting for numerous power, control and data sharing configurations which may be encountered/available at the FOB.

Figure 9A:
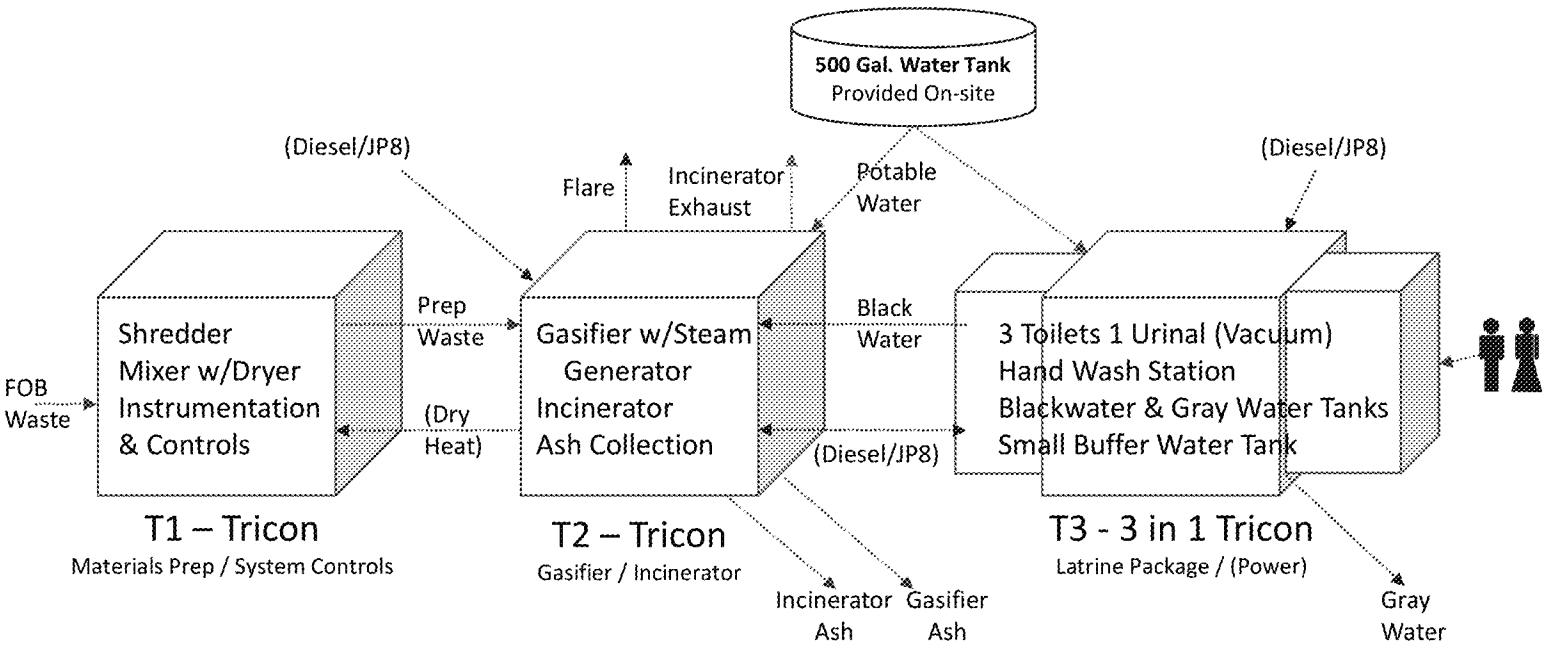
FIGS. 9*a*-9*d* illustrate various exemplary deployment scenarios of the Xw-Box systems of the present embodiments.

In FIG. 9*a*, there are multiple diesel options exemplified, wherein there are multiple diesel tanks for supplying diesel to multiple gensets (e.g., primary and auxiliary) or a single internal diesel tank supplies to the incinerator and an auxiliary genset for the person hygiene facility. One skilled in the art recognizes the various configurations which may be used and routed in accordance with availability at the FOB.

Figure 9B:
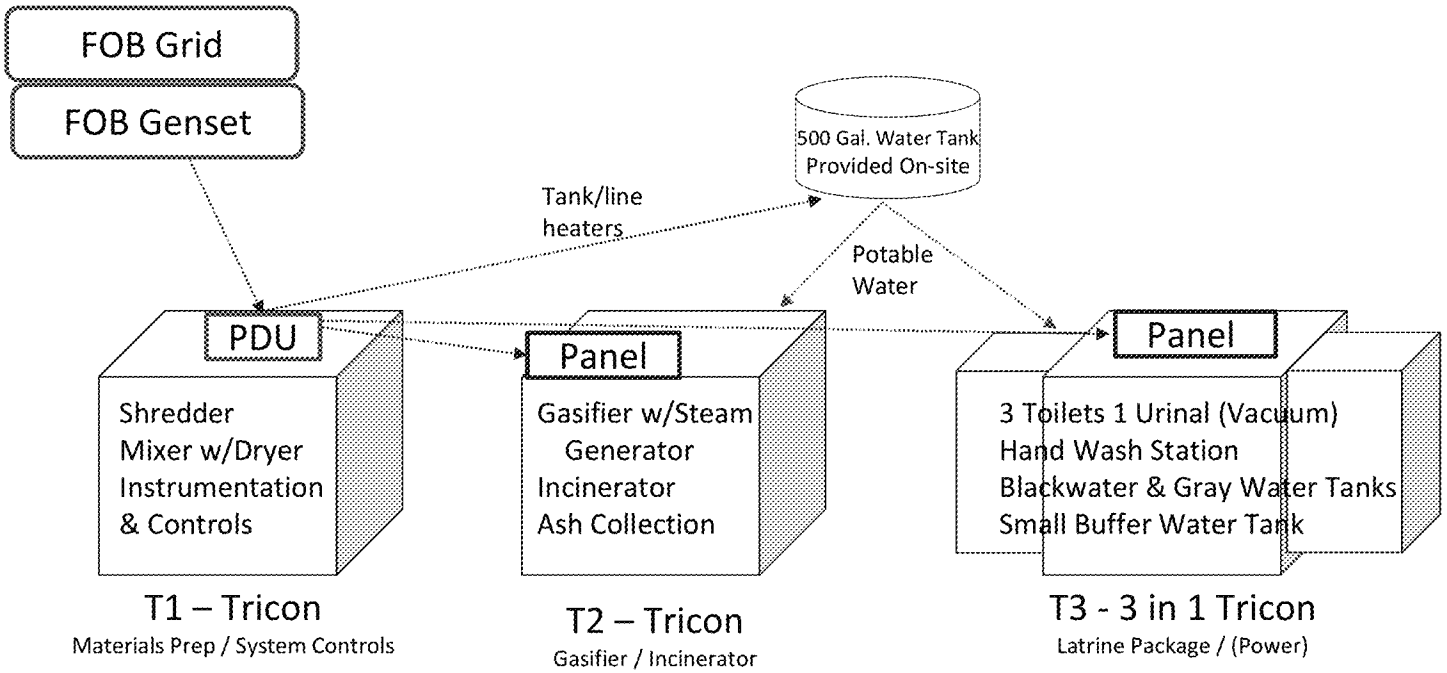

In FIG. 9*b*, the exemplified power system is centralized at a power conversion/inversion and distribution panel (PDU) at T1 which is powered and controlled through the FOB grid and genset. The PDU distributes to independent panels in T2 and T3 as illustrated as well as to an existing water tank/line heaters (to prevent icing/freezing).

Figure 9C:
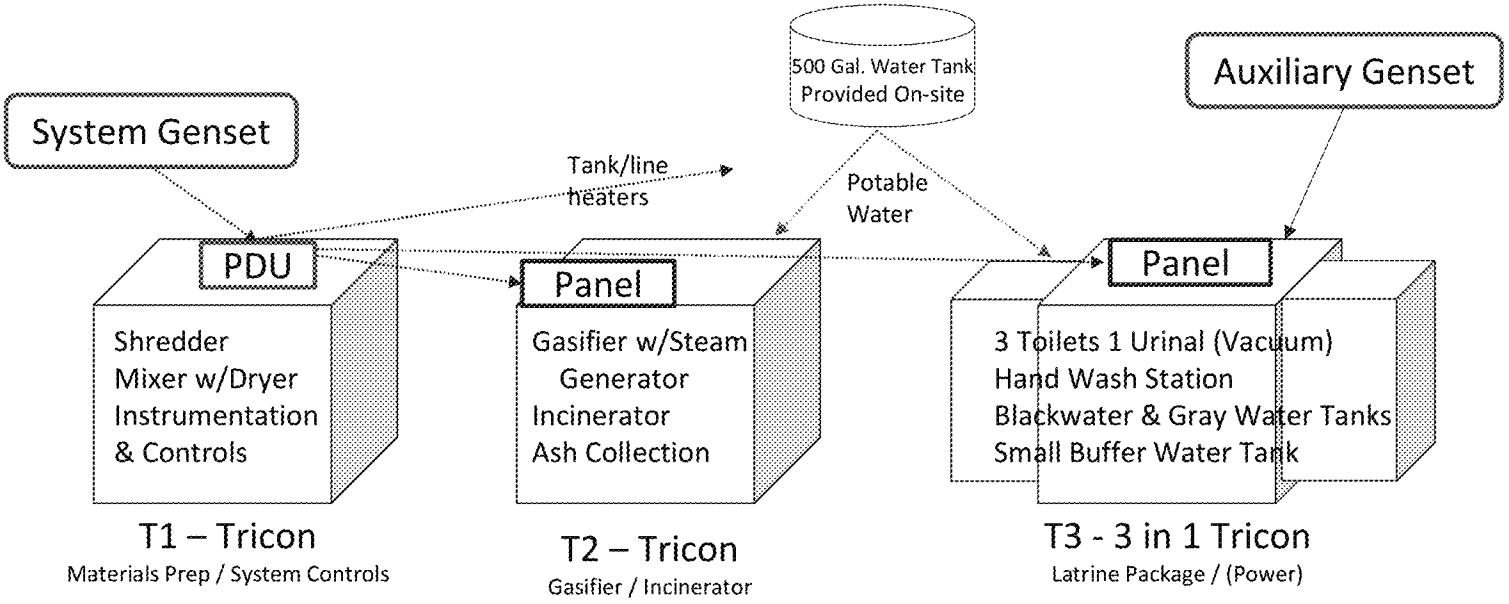

In FIG. 9*c*, the exemplified power system includes a centralized power conversion/inversion and distribution panel (PDU) at T1 which is powered and controlled through a system genset that is separately provided. The PDU distributes to independent panels in T2 and T3 as illustrated as well as to water tank/line heaters. An auxiliary genset with manual transfer switch is stowed in T3 and may be activated to maintain the person hygiene facility when the system genset is down, e.g., for maintenance.

Figure 9D:
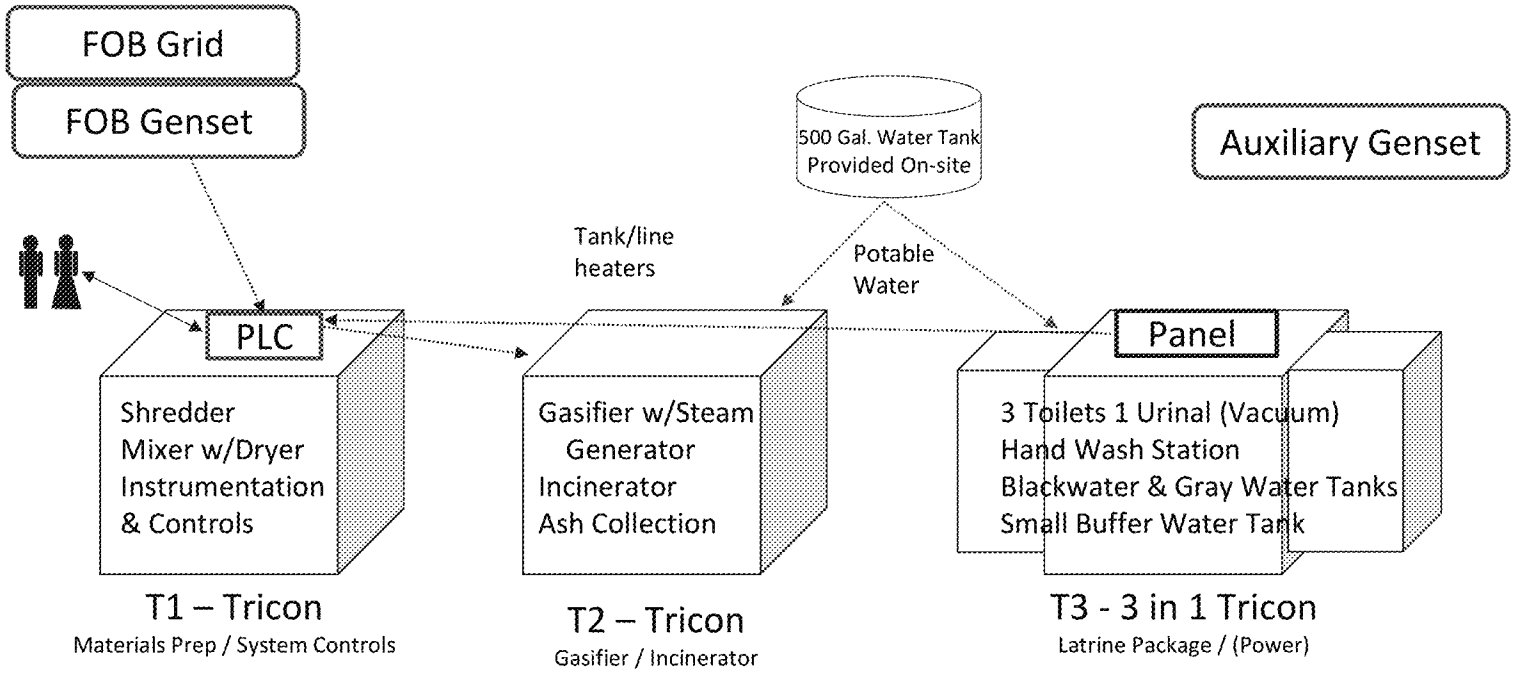

And, in FIG. 9*d*, an exemplified PLC scenario provides for various data inputs/outputs to the centralized PLC of T1. The PLC receives power source amps/volts data from the FOB grid and/or genset, provides the PLC Graphical User Interface (GUI) and receives manual control instructions from users, receives and provides data/control related to temperature, pressure and operational status of the components of T1 and T2 and receives tank level data from T3. The PLC computer also stores system documentation and process interlocks for operator and maintainer safety.

The embodiments described herein are not intended to be exhaustive. One skilled in the art recognizes that there are variations, additions, deletions to the embodiments that though not explicitly recited herein would readily be contemplated by a person having ordinary skill in the art. It is submitted that such variations, additions, deletions are clearly within the scope of the embodiments. Further, though the particular application described herein is directed to a military environment, those skilled in the art recognize other applications and environments wherein the embodiments may be employed, such as at locations without large power and waste infrastructure producing similar waste streams such as amusement parks, outdoor festival/concert venues and natural disaster recovery cites.

The invention claimed is:

1. A system for waste processing comprising:

a feeder for receiving a waste stream of carbonaceous materials, the feeder including a first controllable auger for directing the waste stream;

a reactor for receiving the directed waste stream from the feeder, the reactor including multiple reactor tubes connected in a stacked arrangement, wherein each of the multiple reactor tubes includes a second controllable auger, and a first heating element assembly for converting the carbonaceous materials to syngas and ash; and an incinerator for receiving the syngas from the reactor and for receiving black water waste from a storage tank, wherein the incinerator includes at least one burner fueled by the syngas for incinerating the received black water waste.

2. The system of claim 1 wherein the first controllable auger is plug forming and condenses the carbonaceous materials as it directs them to the reactor.

3. The system of claim 1 wherein the incinerator is an incineration toilet.

4. The system of claim 1 wherein the incinerator includes multi-fuel burners.

5. The system of claim 4, wherein the system further includes a diesel fuel source and the multi-fuel burners may be fueled by syngas and diesel.

6. The system of claim 1 wherein the syngas is directed to the incinerator via a gas blower.

7. The system of claim 1, wherein a speed of the first controllable auger and each of the second controllable augers are independently controllable.

8. The system of claim 1, further comprising a second heating element assembly, wherein the first and second heating element assemblies are separately controllable.

9. The system of claim 1, wherein each of the first heating element assemblies creates multiple heating zones which are immediately adjacent to one another along a periphery of the reactor tube.

10. The system of claim 1, wherein each of the first heating element assemblies creates multiple heating zones which are spaced a distance apart from one another along a periphery of the reactor tube.

11. The system of claim 1, wherein the feeder includes at least one valve at an input thereto.

12. The system of claim 11, wherein the at least one valve is a double rotary star lock valve.

13. The system of claim 1, wherein at least one of the first controllable auger and the second controllable augers is a dual auger.

14. The system of claim 1, further comprising an ash collector bin for receiving the produced ash therein.

15. The system of claim 14, wherein the ash collection bin is removable during continuous waste processing.

* * * * *